US008851790B1

(12) United States Patent
Joyce

(10) Patent No.: US 8,851,790 B1
(45) Date of Patent: Oct. 7, 2014

(54) WATERTIGHT HATCH

(71) Applicant: The Bilco Company, West Haven, CT (US)

(72) Inventor: Roger F. Joyce, Guilford, CT (US)

(73) Assignee: The Bilco Company, West Haven, CT (US)

( * ) Notice: Subject to any disclaimer, the term of this patent is extended or adjusted under 35 U.S.C. 154(b) by 0 days.

(21) Appl. No.: 14/013,554

(22) Filed: Aug. 29, 2013

(51) Int. Cl.
*E02D 29/14* (2006.01)
*E06B 7/23* (2006.01)

(52) U.S. Cl.
CPC ..... *E06B 7/2301* (2013.01); *E02D 29/1427* (2013.01); *E02D 29/14* (2013.01)
USPC ..... 404/25; 49/49; 52/19

(58) Field of Classification Search
CPC ..... E02D 29/14; E02D 29/149; B61D 17/16
USPC ..... 404/25, 26; 52/19, 20; 49/49
See application file for complete search history.

(56) References Cited

U.S. PATENT DOCUMENTS 2,488,796 A * 11/1949 Baier ..... 114/201 R
4,441,724 A 4/1984 Taylor
4,763,449 A * 8/1988 Vigneron et al. ..... 52/20
4,768,684 A 9/1988 Dugge
4,884,723 A 12/1989 Dugge
5,283,979 A 2/1994 Carlson et al.
5,829,358 A 11/1998 Deaver
6,205,931 B1 3/2001 Degutis et al.
6,799,396 B1 10/2004 Redfern et al.
7,044,513 B2 5/2006 Witiak et al.
7,341,398 B2 * 3/2008 Johnson et al. ..... 404/25
8,267,029 B2 9/2012 Burnham
2008/0063471 A1 * 3/2008 Veldboom et al. ..... 404/25
2009/0180832 A1 * 7/2009 Vrondran et al. ..... 404/25

* cited by examiner

*Primary Examiner* — Raymond W Addie

(74) *Attorney, Agent, or Firm* — Wiggin and Dana LLP; Gregory S. Rosenblatt

(57) ABSTRACT

A hatch useful for forming a portal to a sub-surface facility has a cover plate with a plurality of fasteners around its perimeter. These fasteners apply an adjustable compressive force on the cover plate. A compressible material is affixed to the cover plate inward from the perimeter adjacent to the fasteners. A first vertical portion of a rectangular channel has a first end penetrating the compressive material to form a water barrier with the penetration distance being determined by the compressive force. A mechanical stop determines a maximum penetration depth.

12 Claims, 3 Drawing Sheets

WATERTIGHT HATCH

CROSS REFERENCE TO RELATED APPLICATION

N.A.

U.S. GOVERNMENT RIGHTS

N.A.

BACKGROUND

1. Field

This invention relates to a hatch that provides access to a sub-surface facility, such a utility space. More particularly, the hatch includes a watertight seal that is precisely controlled to prevent leakage through the seal due to under-tightening and damage to the seal due to over-tightening.

2. Description of the Related Art

There are numerous hatches having a top surface flush with another surface, such as a sidewalk or roadway. These hatches provide access to an underlying sub-surface facility. The sub-surface facilities frequently contain utility lines, such as power lines or communication lines. It is desirable to prevent the ingress of water, such as during a rainstorm or flood. In the manufacture of hatches, it is known to include a compressible material, such as a gasket, in the assembly to provide a watertight seal. The hatch may be sealed with a plurality of fasteners. As these fasteners are tightened, a penetration force is applied to the compressible material. If the penetration force is too low, a watertight seal is not achieved. If the penetration force is too high, the compressible material is permanently deformed causing a failure in the watertight seal.

An accurate penetration force may be achieved by use of a torque wrench or by accurate measurement of the penetration depth. However, it is desirable to minimize the tools carried by a worker and maximize worker efficiency and these options are not ideal.

U.S. Pat. No. 4,441,724 to Taylor discloses a threaded post that extends through a gasket to prevent undue crushing of gasket. U.S. Pat. No. 4,768,684 to Dugge discloses and I-shaped metallic spacer that controls the deformation of two gaskets located along the narrowed central portion of the spacer. The disclosed systems are not intended for repeated opening and closing. They require a skilled person utilizing tools, gages and specialized fixtures to install. Both U.S. Pat. No. 4,441,724 and U.S. Pat. No. 7,768,684 are incorporated by reference herein in their entireties.

In both disclosures above, spacer accuracy must be carefully controlled and the seal is not intended for frequent opening and closing. There remains, therefore, a need for a watertight seal for a hatch that is frequently opened and closed that is not subject to the above disadvantages.

BRIEF SUMMARY OF THE DISCLOSURE

Disclosed herein is a hatch useful for forming a portal to a sub-surface facility. The hatch has a cover plate with a plurality of fasteners around its perimeter. These fasteners apply an adjustable compressive force on the cover plate. A compressible material is affixed to the cover plate inward from the perimeter adjacent to the fasteners. A first vertical portion of a rectangular channel has a first end penetrating the compressive material to form a water barrier with the penetration distance being determined by the compressive force. A mechanical stop then determines a maximum penetration depth.

A first feature of this hatch is that it forms a watertight seal to keep water such as from rain or flooding out of the sub-surface facility.

A second feature is that the penetration depth is kept within predefined tolerances to prevent under penetration of the compressible material, leading to water leakage, and to prevent over penetration of the compressible material that could cause material deformation, again leading to leakage.

A third feature is that the dimensional aspects are prepared to insure that over-tightening and under-tightening do not occur. This enables an unskilled operator to accurately seal the hatch and to effectively open and close the hatch using conventional tools.

BRIEF DESCRIPTION OF THE DRAWINGS

Like reference numbers and designations in the various drawings indicated like elements.

DETAILED DESCRIPTION

Figure 1:
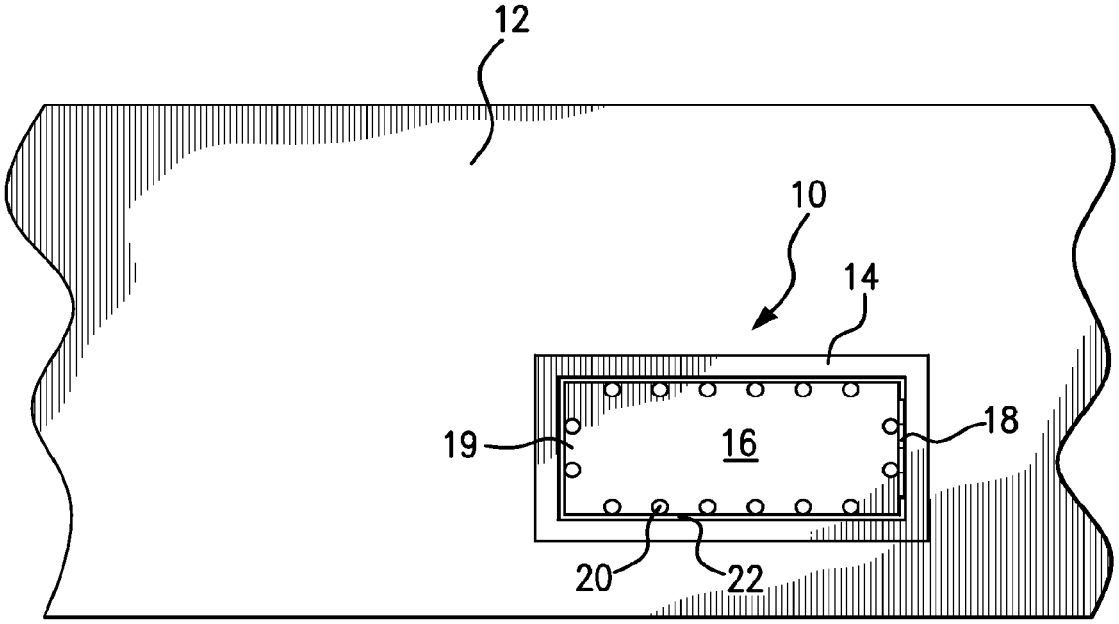
FIG. 1 is a top view of a watertight hatch as disclosed herein.

FIG. 1 is a top view of a hatch 10 having an upper surface that is flush with a surface 12, such as a sidewalk. The same hatch 10 may be installed flush with other surfaces, such as a roadway, town square, subway platform, or any other relatively flat surface used for pedestrian or vehicle transit. Typically the hatch 10 provides access to subsurface utilities such as power or signal lines. The hatch is formed from a suitable material such as aluminum, stainless steel or steel and may be coated to provide weatherproofing, by preventing damage from heat, sun, water, ice melting chemicals, and the like. The hatch 10 has a channel frame 14, typically formed from aluminum, circumscribing a cover plate 16. The cover plate 16 is attached to a hinge 18 at one end allowing it to swing open from the other end 19. To hold the hatch in place and to compress the gasket, a plurality of fasteners 20 are located around the perimeter of the cover plate 16. To enable easy opening and closing of the cover plate 16, a small gap 22, typically with a width of about 3/16 inch, exists between the channel frame 14 and cover plate 16. When water flows over the cover plate, such as in rain or flood conditions, the water flows into the small gap 22. As described below, the hatch 10 is waterproof and effectively prevents the water from contacting the subsurface utilities or other features isolated by the hatch.

Figure 2:
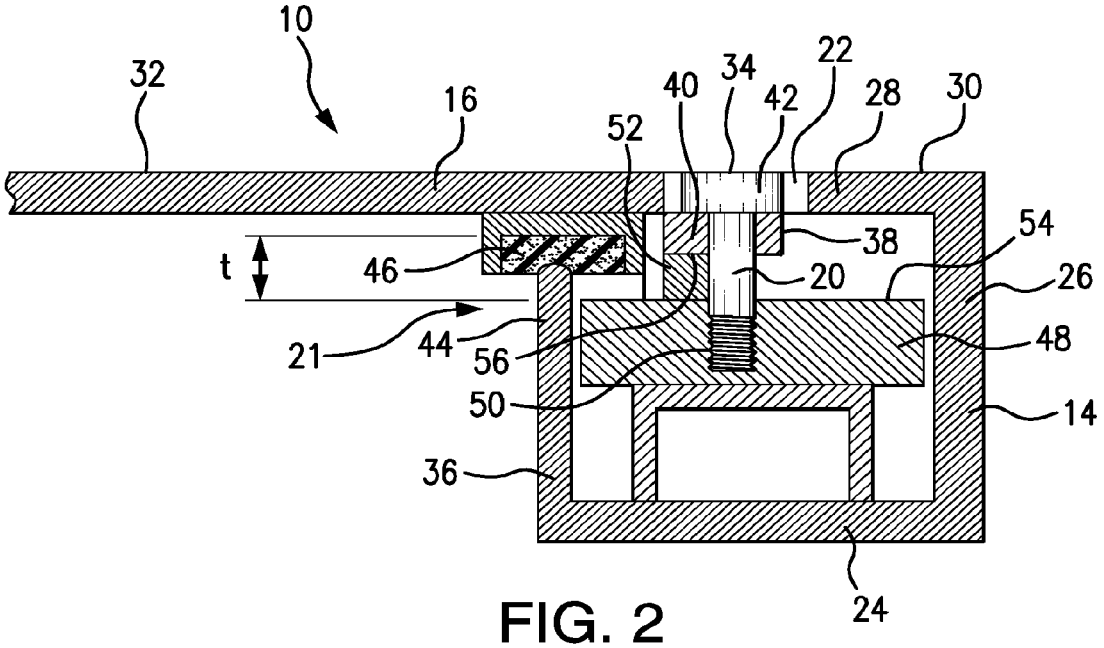
FIG. 2 is a partial cross-sectional view of the watertight hatch of FIG. 1.

FIG. 2 is a cross-sectional view of the hatch 10 showing a watertight seal 21. The channel frame 14 has a partial square or rectangle shape with a first horizontal portion 24 that defines a distance between the edge of the hatch 10 and the cover plate 16. A first vertical portion 26 extends the entire length of the channel frame. A second horizontal portion 28 has a top surface 30 that is flush with both a top surface 32 of the cover plate 16 and a top surface 34 of the fasteners 20. This second horizontal portion 28 extends for a portion of the length of the first horizontal portion enabling the cover plate 16 to extend over, and be supported by, a second vertical portion 36 of the channel frame 14. In addition, a combination of the edge 38 of the cover plate 14 and the shorter length of the second horizontal portion 28 define the gap 22.

Figure 3:
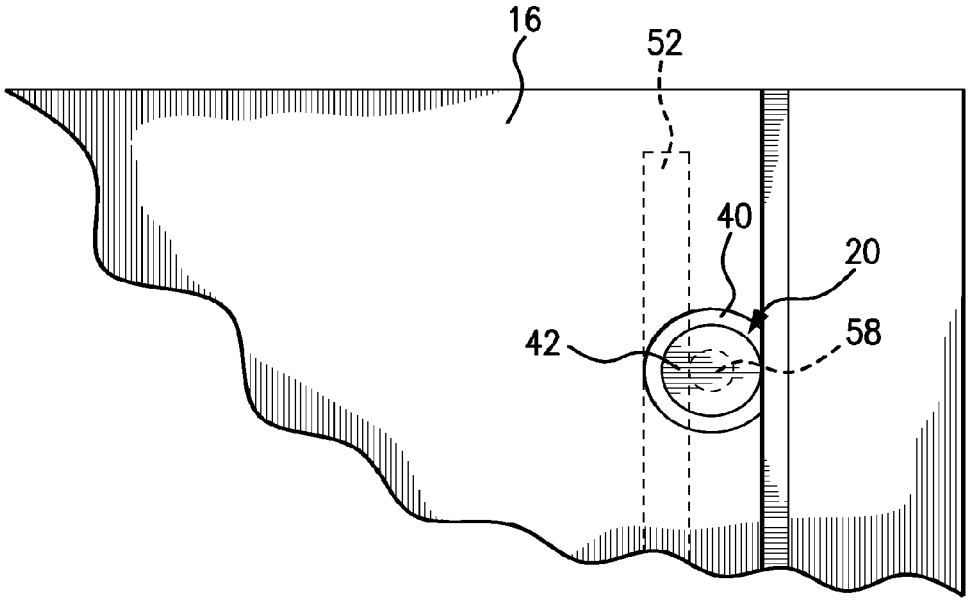
FIG. 3 is a top view of a portion of the watertight hatch of FIG. 1 with underlying structure shown in phantom.

Referring to FIGS. 2 and 3, the edge 38 includes countersunk portions 40 enabling the head 42 of the fastener 20 to be recessed in the cover plate 16 so that top surface 34 of the fastener 20 is flush with the top surface 32 of the cover plated 16 when the hatch 10 is closed.

Referring back to FIG. 2, when the hatch 10 is closed, a free end 44 of the second vertical portion 36 penetrates a compressible material 46 to form a waterproof seal. The compressible material is fanned from a material that is not porous to water and that resiliently returns to its original shape when penetration by the second vertical portion terminates by raising the cover plate 16. A suitable material for the compressible material 46 is neoprene. Other compressible materials that are resilient and weatherproof, such as urethane, may also be used for the gasket. Notwithstanding the resiliency of the compressible material 46, if penetration is too deep, multiple insertions and removals will permanently deform the compressible material and the material will not return elastically to its original shape. If the fastener is under-tightened and there is inadequate penetration, the seal will not be watertight. To maintain both a watertight seal and elasticity, the penetration is limited to from 15% to 35%, in length, of the thickness, t, of the compressible material and most preferably limited to a penetration of from 23%-27%, in length, of the thickness.

The fastener 20 is typically a bolt that is secured to a base 48, such as by the engagement of threads 50. The further the fastener 20 is secured into the base 28, the greater the penetration of the free end 44 into the compressive material 46. To prevent over-tightening of the fastener 20 and the resultant excessive penetration of the compressive material 46, a stop 52 is supported by a top surface 54 of the base 48. When the stop 52 contacts a bottom surface 56 of the countersunk portion 40, the fastener 20 may not be tightened further and the depth of penetration of the free end 44 is controlled. By accurately controlling the thickness of the stop 52, the depth of penetration is accurately controlled.

To prevent movement of the stop 52, the stop is preferably affixed to the top surface 54 of the base 48, such as by welding. As shown in FIG. 3, the stop 52 (shown in phantom under the cover plate 16) has a width effective to extend from a shaft 58 of the fastener 20 to the edge of the countersunk portion 40. The stop may extend for essentially the entire length of the base 48 and underlie a row of fasteners (as seen in FIG. 1) or a separate stop 52 may be associated with each fastener 20. An exemplary stop is formed from a corrosion resistant material such as an aluminum alloy, for example, 6063 aluminum. Exemplary nominal dimensions for the stop 52 are 7/16 inch×7/16 inch×1.75 inches.

Figure 4:
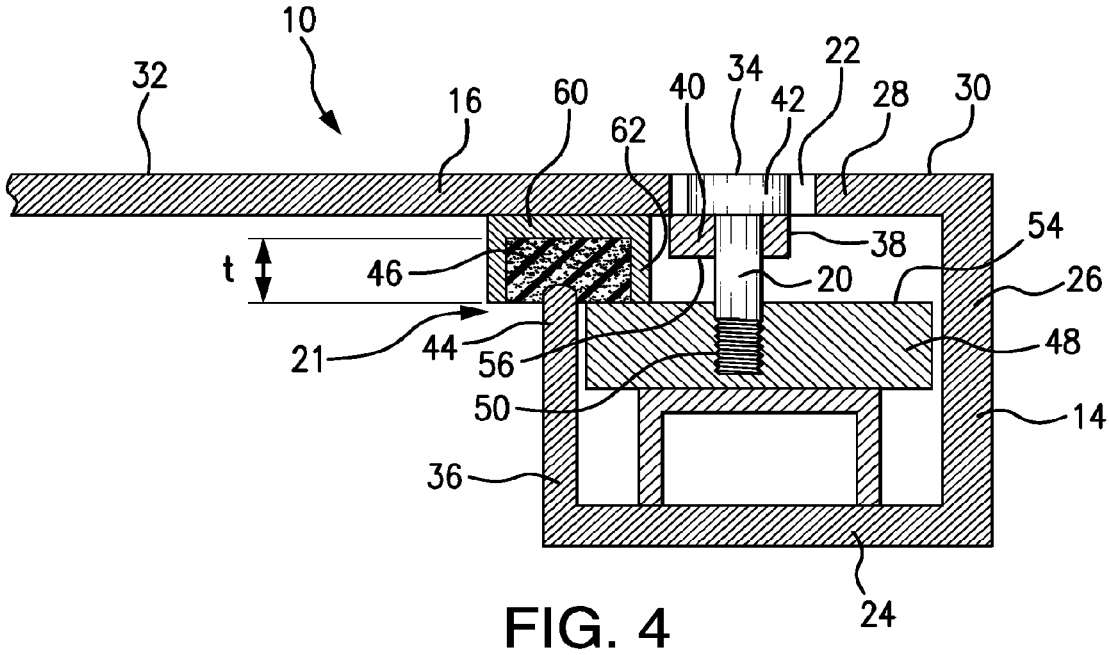
FIG. 4 is a partial cross-sectional view of an alternative watertight hatch.

Alternatively, as shown in FIG. 4, the stop 52 may be omitted and housing 60 for the compressible material 46 has sides 62, some of which, or portions of which, contact top surface 54 the base 48 when the depth of penetration of the free end 44 is at the proper distance.

One or more embodiments of the present invention have been described. Nevertheless, it will be understood that various modifications may be made without departing from the spirit and scope of the invention. Accordingly, other embodiments are within the scope of the following claims.

What is claimed is:

1. A hatch, comprising;

a cover plate having a plurality of fasteners around a perimeter thereof, the fasteners having a threaded end that engages threads in a base that is located within a rectangular channel frame to apply an adjustable compressive force on the cover plate;

a compressible material affixed to the cover plate inward from the perimeter adjacent to the fasteners;

a first vertical portion having a first end penetrating the compressive material to form a water barrier wherein a penetration distance is determined by the compressive force, wherein the first vertical portion is one side of the rectangular channel frame, the rectangular channel frame having an opposing second vertical portion, a first horizontal member connecting a second end of the first vertical portion to a first end of the second vertical portion and a second horizontal member extending from a second end of the second vertical member to a location separated from the perimeter of the cover plate by a gap; and a mechanical stop that determines a maximum penetration depth of from 15% to 35%, in length, of a thickness of the compressible material, wherein the mechanical stop is disposed on a top surface of the base and has a height effective to contact a bottom surface of the cover plate when the maximum penetration depth is obtained.

2. The hatch of claim 1 wherein the maximum penetration depth is from 23% to 27%, in length, of a thickness of the compressible material.

3. A hatch, comprising;

a cover plate having a plurality of fasteners around a perimeter thereof, the fasteners having a threaded end that engages threads in a base that is located within a rectangular channel frame to apply an adjustable compressive force on the cover plate;

a compressible material affixed to the cover plate inward from the perimeter adjacent to the fasteners;

a first vertical portion having a first end penetrating the compressive material to form a water barrier wherein a penetration distance is determined by the compressive force, wherein the first vertical portion is one side of the rectangular channel frame, the rectangular channel frame having an opposing second vertical portion, a first horizontal member connecting a second end of the first vertical portion to a first end of the second vertical portion and a second horizontal member extending from a second end of the second vertical member to a location separated from the perimeter of the cover plate by a gap; and a mechanical stop that determines a maximum penetration depth of from 15% to 35%, in length, of a thickness of the compressible material, wherein the mechanical stop is affixed to one of the top surface of the base and the bottom surface of the cover.

4. The hatch of claim 3 wherein the mechanical stop is welded to the top surface of the base.

5. The hatch of claim 4 wherein both the mechanical stop and the base are formed from stainless steel.

6. The hatch of claim 5 wherein the mechanical stop has a nominal thickness of 7/16 inch.

7. The hatch of claim 3 wherein the compressible material is formed from neoprene.

8. The hatch of claim 7 wherein a hinge extends between the perimeter of the cover plate and the second horizontal portion of the channel frame to facilitate opening and closing of the cover plate.

9. The hatch of claim 8 wherein the gap has a nominal width of 3/16 inch.

10. A hatch, comprising;

a cover plate having a plurality of fasteners around a perimeter thereof, the fasteners having a threaded end that engages threads in a base that is located within a rectangular channel frame to apply an adjustable compressive force on the cover plate;

a compressible material affixed to the cover plate inward from the perimeter adjacent to the fasteners;

a first vertical portion having a first end penetrating the compressive material to form a water barrier wherein a penetration distance is determined by the compressive force, wherein the first vertical portion is one side of the rectangular channel frame, the rectangular channel frame having an opposing second vertical portion, a first horizontal member connecting a second end of the first vertical portion to a first end of the second vertical portion and a second horizontal member extending from a second end of the second vertical member to a location separated from the perimeter of the cover plate by a gap;

a hinge extending between the perimeter of the cover plate and the second horizontal portion of the channel frame to facilitate opening and closing of the cover plate and a mechanical stop that determines a maximum penetration depth of from 15% to 35%, in length, of a thickness of the compressible material, wherein the compressible material is constrained within a housing and a sidewall of the housing forms the mechanical stop.

11. The hatch of claim 10 wherein the compressible material is formed from neoprene.

12. The hatch of claim 10 wherein the gap has a nominal width of 3/16 inch.

* * * * *